US007111726B1

(12) United States Patent
Parsons

(10) Patent No.: US 7,111,726 B1
(45) Date of Patent: Sep. 26, 2006

(54) PROTECTIVE DISPLAY AND GIFT PACKAGE

(75) Inventor: Kevin L. Parsons, Appleton, WI (US)

(73) Assignee: Armanent Systems & Procedures, Inc., Appleton, WI (US)

( * ) Notice: Subject to any disclaimer, the term of this patent is extended or adjusted under 35 U.S.C. 154(b) by 190 days.

(21) Appl. No.: 10/869,607

(22) Filed: Jun. 16, 2004

(51) Int. Cl.
*B65D 5/50* (2006.01)

(52) U.S. Cl. ..... 206/45.23; 206/6.1; 206/566; 206/759

(58) Field of Classification Search ..... 206/772–773, 206/759, 776, 45.2, 45.23, 303, 446, 349, 206/6.1, 566
See application file for complete search history.

(56) References Cited

U.S. PATENT DOCUMENTS 1,005,968 A * 10/1911 Hauser ..... 206/45.23
1,944,714 A * 1/1934 Lehmann ..... 206/759
2,860,767 A * 11/1958 Shiffman ..... 206/45.23
2,880,857 A * 4/1959 Parsons et al. ..... 206/45.2
3,314,739 A * 4/1967 Mendelson ..... 206/45.2
3,884,349 A * 5/1975 Charles ..... 206/45.2
D273,721 S 5/1984 Ronzani
D291,024 S 7/1987 Kikuchi
4,749,082 A 6/1988 Gardiner et al.
6,131,740 A * 10/2000 Huang ..... 206/759
6,209,242 B1 * 4/2001 Marshall ..... 206/566
6,398,026 B1 6/2002 Parsons

OTHER PUBLICATIONS 9 pages of digital photographs of ZIPPO plastic case—date more than 1 year prior to the filing date of this application.

* cited by examiner

*Primary Examiner*—Bryon P. Gehman
(74) *Attorney, Agent, or Firm*—Welsh & Katz, Ltd.

(57) ABSTRACT

A protective display and gift package includes a base defining a product support surface, a product support clasp pivotally mounted on the product support surface and operative to releasably support a product, and a cover pivotally connected to the base for movement between a first position mutually cooperable with the base to overlie the product display surface and a product supported by the clasp, and a second position supporting the base in an upstanding position with the product display surface and product support clasp exposed. The clasp enables the product to be selectively rotated relative to the product support surface and enables customers and merchants to view and display the product from various angles.

23 Claims, 2 Drawing Sheets

PROTECTIVE DISPLAY AND GIFT PACKAGE

BACKGROUND OF THE INVENTION

The present invention relates generally to product display and gift package devices, and more particularly to a product packaging and display device that is adapted to protect a displayed product, enables exposure and selective positioning of the displayed product, and can be used as a gift box.

It is a conventional marketing technique to display consumer products, particularly relatively small high-volume products of hand-holdable size, so as to draw maximum consumer attention. It is known, for example, to package products within clear plastic "blister packs" or clamshell packets that enable the consumer to visually identify one or more products disposed within the blister pack or clamshell packet. Product information or brand indicia may be provided on a header card attached to the blister pack or clamshell packet, or on a separate card disposed within the blister pack or clamshell packet. Such blister pack and clamshell packet packaging is particularly favored for hand-holdable size, high-volume, relatively low-cost products. A significant drawback in this type of packaging, however, is that it does not allow selective orientation of a product within the package and frequently does not lend itself to traditional gift wrapping because of its generally irregular shape. As a result, products employing such packaging are often overlooked when a customer is considering purchase of a product for gift giving purposes. In addition, such packaging is generally not acceptable for use by high-end retailers, such as those selling jewelry, upscale gifts, or high priced specialty products.

Another drawback in the use of plastic blister pack or clamshell packet type packaging that is made from a relatively flexible transparent plastic is that the flexible plastic often directly contacts the product creating a potential for damage to the product during shipment and subsequent handling. Further, blister pack and clamshell type packaging generally do not allow the product to be exposed for close-up inspection by a potential purchaser without damaging the blister pack or clamshell package. Should a customer break open a blister pack, for example, the enclosed product may release from the package and become scratched or otherwise damaged. Also, once opened, it is generally difficult for a merchant to sell a product in an already-opened blister pack or clamshell package type packaging even though re-sealed by staples or tape, unless the product is deeply discounted.

Product packaging traditionally used for higher-end products, such as jewelry, generally utilizes two-piece type relatively rigid cases having a base and top cover that may be hinged to the base or fully releasable to create an open product display condition that enables the products to be removed, examined, and re-inserted into the package or case without harm or damage to the product or packaging. Such packaging generally adds a significant cost factor to the product. Moreover, such two-piece rigid type packaging generally supports the product in a relative fixed position that allows a customer to view the product at a specific angle but requires removal from the package for better observation.

There thus exists a need for a relatively inexpensive product display and gift type package that enables selective orientation of a product supported within the package, protects a displayed product when the package is in a closed condition, and can be opened without damage to the package or product so as to present a product on an upwardly inclined exposed position allowing a customer to touch the product and manipulate it or remove the product if desired. The package or case should also facilitate attractive gift wrapping conducive to sales by higher-end retailers.

BRIEF SUMMARY OF THE INVENTION

In carrying out the present invention, a protective product display and gift package is provided that includes a base having a product support surface that has a product receiving cavity or recess thereon defined by a substantially circular wall normal to the product support surface. A product support clasp is rotatably supported on the product support surface generally centrally of the product receiving recess and is operative to releasably receive and support a product for display in a selective orientation relative to the support surface. A cover is pivotably mounted on the base and is movable between a first position cooperative with the base to provide a protective cover for a product supported by the clasp, and a second position supporting base so that the product support surface is disposed in a generally upstanding position and exposing a product supported by the clasp. The base is preferably generally rectangular and has at least two laterally spaced sidewalls. The cover has at least two laterally spaced sidewalls pivotally connected to the base sidewalls so as to be pivotally movable between its first and second positions relative to the base. The base and cover sidewalls are mutually cooperable to limit pivotal movement of the cover so that the base product support surface is inclined at an angle from vertical when the cover is in its second position with marginal edges of the cover sidewalls disposed on a substantially horizontal support surface. The clasp and base support surface have mutually cooperable detent means operative to releasably retain the clasp in selective rotational positions relative to the product support surface to thereby facilitate selective orientation of a product supported by the clasp for optimum visual display. The clasp includes a pair of outwardly extending laterally spaced retaining fingers operative to receive and releasable retain a product therebetween, such as a hand-holdable generally rectangular shaped flashlight having an on-off switch on a side panel that can be exposed to enable a potential customer to energize a light disposed at an end of the flashlight.

In a preferred embodiment, the base, clasp, and cover are made of a suitable plastic. The base is preferably opaque and the cover is preferably transparent to allow both customers and merchants to observe a product supported on the clasp. The base also includes a generally flat surface area for receiving product and/or brand indicia in the form of direct printing, a printed sticker, or indicia die-molded into the base during manufacture.

A feature of the product display and gift package in accordance with the present invention lies in forming the base and cover as rectangular shaped members having peripheral sidewalls and being mutually cooperable to define a relatively closed protective chamber that receives the clasp and a product supported on the clasp.

Another feature of the product display and gift package in accordance with the invention lies in forming the cover as a transparent plastic member adapted for pivotal mounting on the base so that a planar surface of the cover overlies and is spaced from a product supported on the clasp.

Yet another feature of the product display and gift package in accordance with the invention lies in mounting the clasp on the base product support surface by means of a split pivot shaft enabling release of the clasp from the base for interchanging with a different size clasp if desired.

Still another feature of the product display and gift package in accordance with the invention lies is providing mutually cooperable detents on the clasp and base product support surface to enable selective angular positioning of the clasp in predetermined increments so that a product supported on the clasp can be optimally positioned for customer observation of product features.

Further objects, features, and advantages of the present invention, together with the organization and manner of use thereof, will become apparent from the following detailed description of the invention when taken in conjunction with the accompanying drawings wherein like reference numerals designate like elements throughout the several views. It will be understood that the invention is susceptible to various modifications and alternative forms and that the drawings and detailed description thereof are not intended to limit the invention to the particular form disclosed, but rather the invention is intended to cover all modifications, equivalents, and alternatives falling within the spirit and scope of the invention.

DETAILED DESCRIPTION OF THE INVENTION

Figure 1:
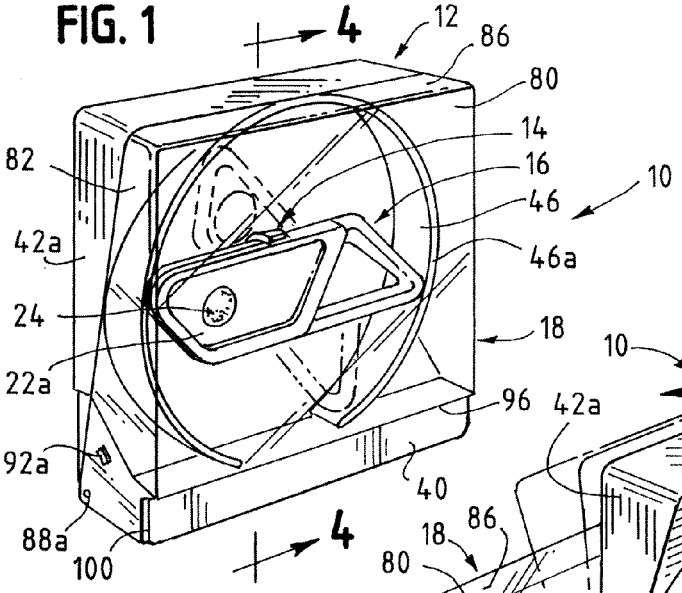
FIG. 1 is a perspective view of a protective display and gift package in accordance with a preferred embodiment of the present invention, the package being depicted in a closed condition displaying a product in the form of an LED flashlight.
Figure 2:
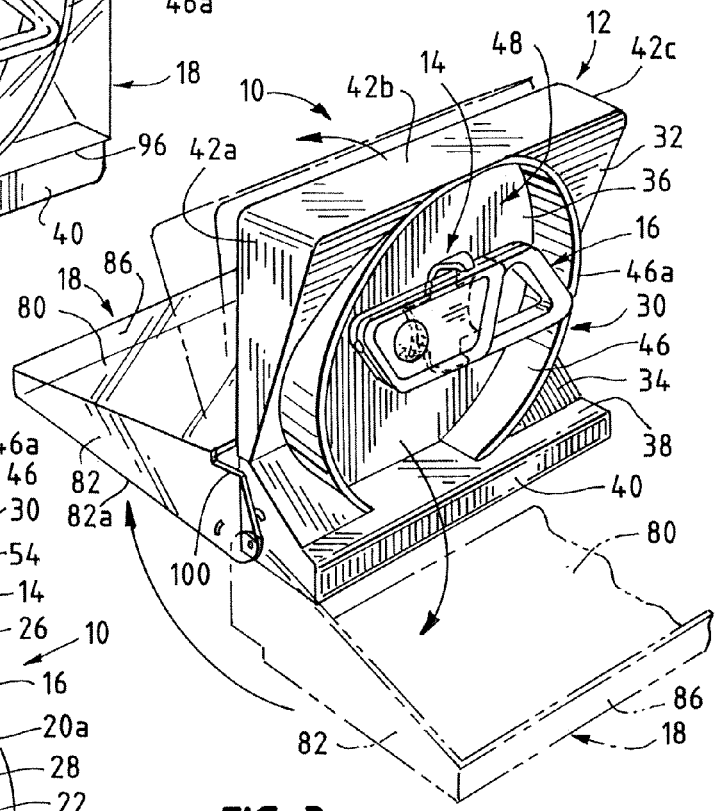
FIG. 2 is a perspective view of the package and flashlight of FIG. 1, but showing the cover being moved to an open product display positioning.
Figure 4:
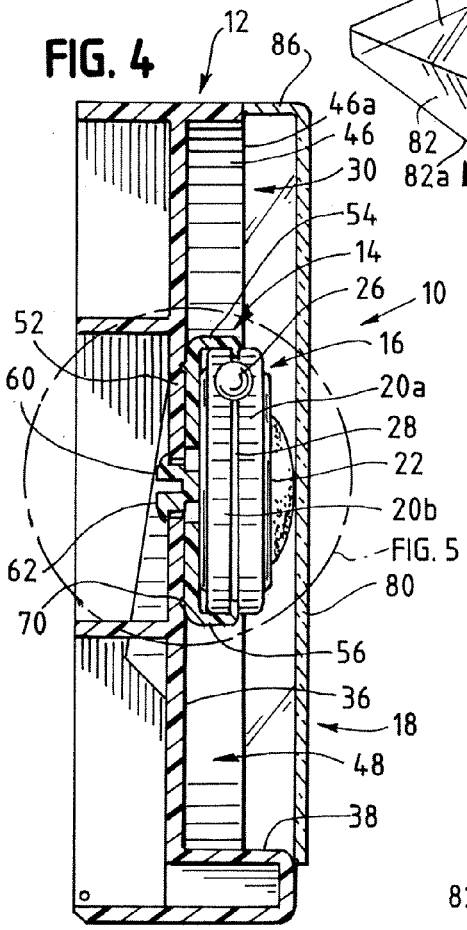
FIG. 4 is a cross-sectional view of the package and displayed flashlight taken generally along line 4—4 of FIG. 1.
Figure 3:
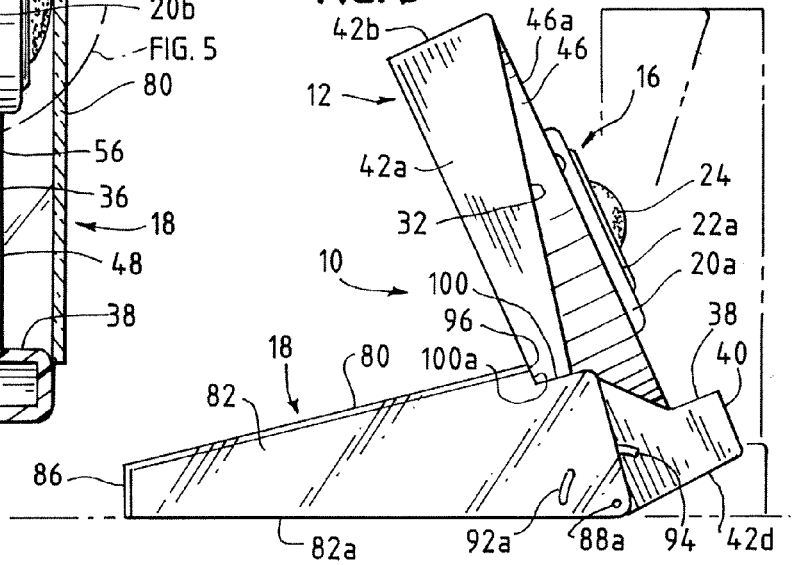
FIG. 3 is a side view of the package and flashlight of FIG. 2, but with the cover in an open position supporting the base in an upwardly inclined open upright condition.

Referring now to the drawings, and in particular to FIGS. 1–3, a protective product display and gift package constructed in accordance with a presently preferred embodiment of the invention is indicated generally at 10. Briefly, the protective product display and gift package 10, which may hereinafter be referred to simply as a product display package or a gift package includes a base 12, a product support clasp 14 rotatably mounted on the base and operative to support a product 16, and a cover 18 moveable between a first position overlying and protecting the product 16, and a second open position exposing the product in a display position for closer observation and manipulation by a prospective purchaser. In the illustrated embodiment, the product 16 comprises a hand-holdable generally rectangular shaped LED flashlight having a pair of power source frame housings 20*a* and 20*b* that support side covers 22*a,b*, an on-off switch button 24, and a light source in the form of an LED light 26 extending from a forward end of the flashlight, such as disclosed in U.S. Pat. No. 6,190,018 assigned to the assignee of the present invention and incorporated herein by reference. The frame housings 20*a,b* are configured to define a channel or grove 28 therebetween that extends at least along the upper and lower longitudinal marginal edges of the connected frame housings.

The base 12 is preferably made of a molded lightweight opaque plastic and is generally rectangular or square when considered in a plan or upstanding elevational view as in FIGS. 1 and 2. The base 12 has a product display side 30 defined by inclined planar surfaces 32 and 34, a planar generally circular product support surface 36 that intersects a planar surface 38, and a planar rectangular surface 40 formed integral with an outer margin of surface 38 and lying in a plane parallel to the product support surface 36. The base 12 includes sidewalls 42*a–d* that intersect at right-angle corners and also intersect the upper base surfaces 32, 34, 38 and 40. The sidewalls 42*a–d* have lower marginal edges lying in a common plane parallel to the product support surface 36. The rectangular surface 40 enables product information or brand indicia, such as a trademark, to be printed thereon, presented on an applied label, or impressed therein by a die during die-forming of the base 12. The outer margin of the generally circular product support surface 36 is defined by a substantially circular wall 46 integral with and normal to the product support surface. An outer marginal edge 46*a* of the circular wall 46 lies in a plane parallel to the product support surface 36 and thereby also the lower marginal edges of the sidewalls 42*a–d*. The wall 46 cooperates with the product support surface 36 to define a product receiving cavity or recess 48. The diameter and height of the wall 46 relative to the product support surface 36 are selected to establish a diameter and depth of the cavity or recess 48 sufficient to permit a predetermined maximum size product, such as flashlight 16, to be supported by the clasp 14 and undergo limited rotation and selective angular orientation in a plane generally parallel to the product support surface 36.

The product support clasp 14 is rotatably mounted centrally within the product receiving cavity 48. Referring to FIGS. 4–7, the clasp 14 is preferably made of a suitable plastic material that lends itself to injection molding and has a generally planar plate portion 52 having a pair of substantially identical forwardly directed support arms 54 and 56 formed integral thereon as mirror images of each other. Each of the arms 54, 56 has an outer end in the form of an L-shaped retaining flange or lip as indicated at 54*a* and 56*a*, respectively. In the illustrated embodiment, the retaining arms 54 and 56 are sized and sufficiently flexible to releasable receive and retain the flashlight 16 in supported relation between the arms with the retaining lip ends 54*a* and 56*a* received within the channel or groove 28 defined along the peripheral edge of the flashlight.

Figure 5:
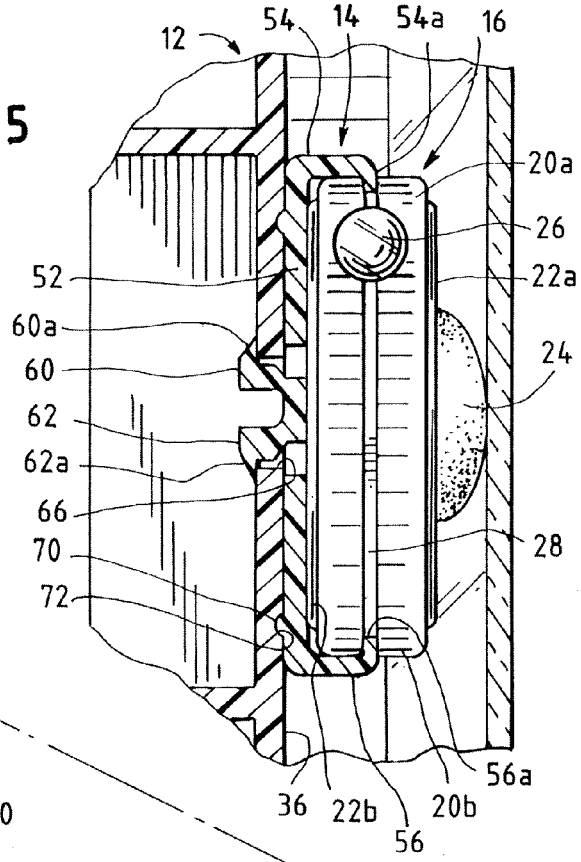
FIG. 5 is an enlarged fragmentary sectional view of the circled portion of FIG. 4.
Figure 7:
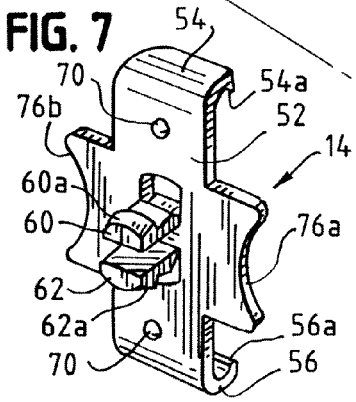
FIG. 7 is a rear perspective view, on an enlarged scale, of the clasp shown in FIG. 6.

Referring particularly to FIG. 7, a rearward surface of the plate portion 52 of the clasp 14 has a pair of relatively rigid but flexible mounting fingers 60 and 62 formed integral with the plate portion adjacent its center. The mounting fingers are spaced apart in a manner to enable the mounting fingers to be pinched toward each other when mounting the clasp on the product support surface 36. The mounting fingers 60 and 62 have enlarged outer ends on which outer arcuate inclined surfaces 60*a* and 62*a* are formed to facilitate insertion of the mounting fingers into a circular opening 66 formed centrally within and through the product support surface 36. The opening 66 has a smaller radius than the mean radius of the arcuate surfaces 60*a* and 62*a* so that when the mounting fingers 60 and 62 are inserted into the opening 66 the mounting fingers are pinched together until the enlarged ends pass through the opening and spring outwardly to retain the clasp on the support surface 36, as shown in FIG. 5. The mounting fingers 60 and 62 thus define a split or bifurcated support shaft for the clasp when supported within the opening 66 in the product support surface so as to enable rotation of the clasp 14 about the center axis of opening 66. When mounted on the product support surface 36, pinching the enlarged ends of the mounting fingers together enables release of the clasp from the product receiving cavity 48 in the base 12 for changing to a clasp for supporting a product having a different shape within the product display cavity 48.

In accordance with the preferred embodiment, the rearward surface of the plate portion 52 of the clasp 14 has a pair of outwardly extending semispherical knobs or detents 70 formed thereon that lie on a common diameter through the center of the plate portion and are cooperable with a plurality of semispherical recesses 72 formed in the product support surface 36. The recesses 72 lie on a common diameter concentric with the opening 66 that receives the clasp mounting fingers 60 and 62 and are spaced to cooperate with the detents 70 to facilitate selective rotational positioning of the clasp relative to the product support surface 36, thereby enabling selective orientation of the flashlight 16 relative to the base product display cavity 48. When used to display a flashlight 16 having an on-off switch 24 mounted within a side panel 22 of the flashlight, the planar plate portion 52 of the clasp is preferably formed with lateral portions having arcuate surfaces 76*a* and 76*b* formed thereon to provide clearance for the on-off button 24 when the flashlight is mounted within the clasp with the on-off switch facing the product support surface 36.

Figure 6:
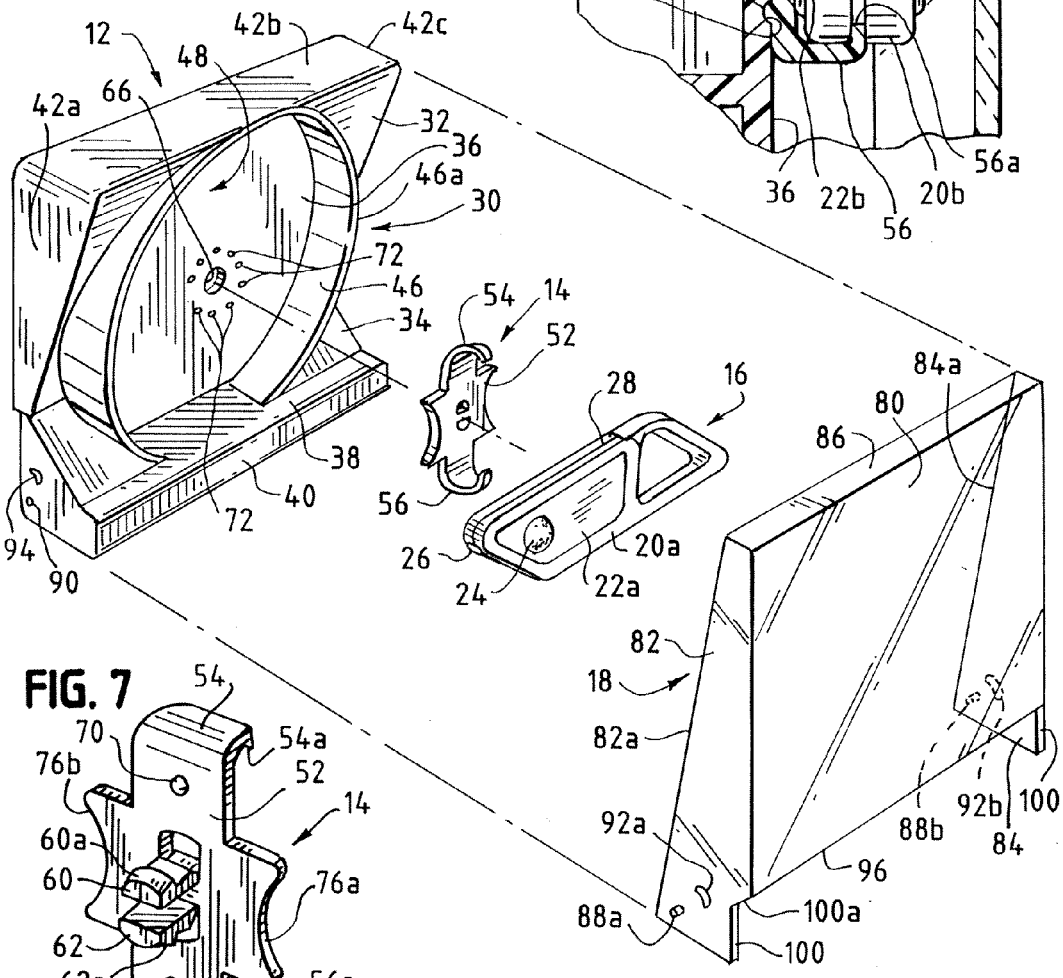
FIG. 6 is an exploded perspective view of the package and flashlight of FIG. 1.

Referring now to FIGS. 1–3, taken in conjunction with FIG. 6, the cover 18 is preferably made of a suitable relatively rigid transparent plastic having a generally rectangular planar panel 80, a pair of laterally spaced sidewalls 82 and 84 integrally connected in normal relation to marginal edges of the panel 80, and an end wall 86 formed integral with and normal to a transverse marginal edge of the panel 80. The lateral width of the cover panel 80 and thereby also the sidewalls 82 and 84 are equal to the lateral width of the inclined surface 32 on the base 12 so that inclined marginal edges 82*a* and 84*a* of the cover sidewalls 82 and 84 engage the lateral edges of the inclined base surface 32 when the cover is in a closed position on the base. The marginal edges 82*a* and 84*a* on the cover sidewalls 82 and 84 are tapered so that when the cover 18 is in a closed position on the base, a substantially rectangular display and gift package is created as considered in side profile.

As aforenoted, the cover 18 is mounted on the base 12 for pivotal movement between a first closed position on the base and a second open position supporting the product display surface 36 in an upwardly inclined exposed position. To this end, the cover sidewalls 82 and 84 have inwardly directed axially aligned cylindrical pivot pins 88*a* and 88*b* formed thereon, respectively, that are adapted to be received within suitably sized axially aligned cylindrical openings formed in the base 12, one of which is indicated at 90 in FIG. 6, to thereby pivotally mount the cover 18 onto the base 12. The base sidewalls 42*a* and 42*c* are inset in the areas about the openings 90 to receive the corresponding ends of the cover sidewalls so that the outer surfaces of the laterally opposed sidewalls on the base and cover are substantially coplanar. Preferably, the ends of the cover sidewalls 82*a* and 84*a* adjacent the pivot pins 88*a,b* also have laterally aligned inwardly extending arcuate detents 92*a* and 92*b* that are adapted to be received within similarly configured arcuate recesses formed in the base sidewalls 42*a* and 42*c*, one of which is indicated at 94 in FIG. 6, when the cover is in its fully closed position with the inclined margined edges 82*a* and 84*a* of the cover engaging the inclined surface 32 of the base. The mutually cooperable detents 92*a,b* and recesses 94 releasably retain the cover in its closed position overlying the product display surface 36 but enable pivotal movement of the cover to its open position. The rectangular cover panel 80 has a free marginal edge 96 that is juxtaposed to the planar base surface 38 when the cover is in its closed position on the base 12, thereby leaving the product information indicia on the base surface 40 exposed.

To facilitate support of the base 12 in a generally inclined upstanding position with the product display surface 36 and clasp 14 exposed when the cover is in its open position, the ends of the cover sidewalls 82 and 84 opposite the end wall 86 are recessed at 100 so as to form a stop surface 100*a* adjacent the corresponding recess 100. The recesses 100 and stop surfaces 100*a* are configured to enable the cover 18 to be pivoted about the pivot axis established by the pivot pins 88*a,b* to a position as illustrated in FIG. 3 wherein the cover stop surfaces 100*a* engage the bottom marginal edges of the base sidewalls 42 and 42*c* so that the base is disposed at a predetermined angle from vertical when the open cover sidewalls are supported on a substantially horizontal surface. In this manner, the product, such as flashlight 16, supported on the clasp 14 is readily visually observable by a potential customer who can manually manipulate the flashlight if desired for optimal observation.

Having thus described a preferred embodiment of a protective product display and gift package, it will be understood that changes and modifications may be made therein without departing from the invention in its broader aspects. Various features of the invention are defined in the following claims.

What is claimed is:

1. A protective display and gift package comprising:

a generally rectangular base having a generally planar circular product support surface and laterally spaced sidewalls having free coplanar marginal edges disposed in a plane substantially parallel to said product support surface;

a clasp supported on said support surface and operative to releasably support a product for selective rotational orientation of the product relative to said support surface; and a cover having a generally planar rectangular wall and laterally spaced sidewalls pivotably connected to the base, said cover being pivotally movable between a first position wherein said rectangular wall cooperates with the base to provide a protective cover for a product supported by the clasp, and a second position wherein a marginal transverse edge of the cover cooperates with the free marginal edges of the base sidewalls to support the product support surface in a generally upstanding position exposing a product when supported by the clasp.

2. A protective display and gift package as defined in claim 1 wherein said base sidewalls and marginal transverse edge of the cover are mutually cooperable to limit pivotal movement of said cover so that said base product support surface is inclined at an angle from vertical when the cover is in its second position with the free marginal edges of said cover sidewalls disposed on a substantially horizontal surface.

3. A protective display and gift package as defined in claim 1 wherein the clasp is rotatably supported on the base support surface so that a product supported by the clasp is selectively rotatable in a plane generally parallel to said support surface to varying rotational positions.

4. A protective display and gift package as defined in claim 3 wherein said clasp and base support surface are mutually cooperable to enable rotation of said clasp between selective stationary rotational positions relative to the support surface.

5. A display and gift package as defined in claim 1 wherein the cover is formed of a transparent material to permit viewing of a product supported by the clasp.

6. A display and gift package as defined in claim 1 wherein the base laterally spaced sidewalls and cover sidewalls include mutually cooperable laterally aligned apertures and pivot pegs operative to facilitate pivotal connection of the cover to the base.

7. A display and gift package as defined in claim 1 wherein the product support surface includes a centrally located aperture, and the clasp includes a post adapted for releasable retention in said aperture so as to permit rotation of the clasp about the axis of the post.

8. A display and gift package as defined in claim 1 wherein the clasp is formed of plastic.

9. A display and gift package as defined in claim 1 wherein the base and cover are configured to define a generally rectangular package when said cover is in said first position, said cover having a substantially planar transparent portion juxtaposed to said product support surface so as to enable visual observation of a product supported on the clasp.

10. A protective display and gift package comprising:

a base having a product support surface;

a clasp rotatably supported on said support surface and operative to releasably support a product for selective rotation in a plane generally parallel to said support surface; said clasp and base support surface have mutually cooperable detent means operative to releasably retain the clasp in selective rotational positions relative to the product support surface; and a cover pivotably connected to the base and movable between a first position cooperative with the base to provide a protective cover for a product supported by the clasp, and a second position supporting the support surface in a generally upstanding position and exposing a product when supported by the clasp.

11. A protective display and gift package as defined in claim 10 wherein the clasp includes at least two outwardly extending laterally spaced retaining fingers operative to receive and releasably retain a product therebetween.

12. A protective display and gift package as defined in claim 10 wherein the clasp is removably supported on the product support surface for rotation about an axis normal to the product support surface.

13. A display and gift package as defined in claim 10 wherein at least one of the base and cover is formed of plastic.

14. A display and gift package as defined in claim 10 wherein the mutually cooperable detent means enable the clasp to click-stop into one of a plurality of selective rotational positions so as to orient a product supported by the clasp at a predetermined angular position relative to the base product support surface.

15. A protective display and gift package comprising:

a base having a product support surface including a generally circular planar surface portion bounded by a substantially annular wall portion fixed in normal relation to and extending outwardly from said planar portion;

a clasp supported on said support surface generally at the center of and encircled by said substantially annular wall portion, said clasp being operative to releasably support a product for selective orientation of the product relative to said support surface; and a cover pivotably connected to the base and movable between a first position cooperative with the base to provide a protective cover for a product supported by the clasp, and a second position cooperative with the base for supporting the support surface in a generally upstanding position and exposing a product when supported by the clasp.

16. A protective display and gift package as defined in claim 15 wherein said clasp is sized to receive and support an elongated generally rectangular shaped flashlight having a light disposed at an end thereof, said annular wall being sized to substantially encircle the flashlight when supported on the clasp.

17. A protective display and gift package as defined in claim 15 wherein said base and cover are mutually cooperable to substantially enclose a product supported on the clasp when the cover is in its first position, and wherein at least a portion of the cover that overlies the clasp is transparent to enable a product supported on the clasp to be visually observed.

18. A protective display and gift package comprising:

a base having a product support surface and a flat surface area offset forwardly from said support surface and adapted to receive identification indicia thereon;

a clasp supported on and mutually cooperable with said support surface through detent means operative to releasably support a product for selective rotational orientation of the product in a plane generally parallel to said support surface; and a cover pivotably connected to the base and movable between a first position cooperative with the base to provide a protective cover for a product supported by the clasp, and a second position supporting the support surface in a generally upstanding position and exposing a product when supported by the clasp, said cover being configured so that said offset flat surface area is exposed when said cover is in said first and second positions.

19. A display package comprising:

a rectangular base having laterally spaced sidewalls affixed to laterally opposite margins of the base;

a substantially circular product support surface formed on the base; said base having a discrete generally rectangular transverse surface forwardly offset from said product support surface for exhibiting indicia thereon;

a clasp supported on said product support surface and being operative to releasably support a product for rotation in a plane generally parallel to the product support surface, said clasp and product support surface having mutually cooperable detent means operative to releasably retain the clasp in selective rotational positions relative to the product support surface; and a cover having sidewalls juxtaposed to said base sidewalls and pivotally connected thereto, said base and cover being mutually cooperable to enable movement of said cover between a first position forming an enclosed package for protecting a product supported by the clasp, and a second position wherein the base is disposed in an upwardly extending position and a product supported by the clasp is exposed for viewing from externally of the display package, said cover being configured such that said offset transverse surface is exposed with said cover in its said first and second positions.

20. A protective display and gift package comprising:

base means defining a product receiving chamber having a generally planar product support surface having an opening formed generally centrally thereof;

clasp means including a plate portion having a pair of product support arms formed thereon for releasably supporting a product, said clasp means including means associated with said plate portion for releasable insertion into said opening so as to support said clasp means on said support surface said clasp means and product supported surface having mutually cooperable detent means operative to retain the clasp means and a supported product in selective rotational orientation of the product in a plane generally parallel to said product support surface; and cover means pivotably connected to the base means for movement between a first position cooperative with the base means to provide a protective cover for a product supported by the clasp means, and a second position cooperative with the base means for supporting the base means in a generally upstanding position and exposing a product when supported by the clasp means.

21. A protective display and gift package as defined in claim 20 wherein said base means comprises a generally rectangular base member having at least two laterally spaced sidewalls, said cover means comprising a generally rectangular cover having laterally spaced sidewalls pivotally connected to said base member sidewalls so as to be pivotally movable between said first and second positions.

22. A protective display and gift package as defined in claim 21 wherein said base member sidewalls and cover sidewalls are mutually cooperable to limit pivotal movement of said cover so that said base product support surface is inclined at an angle from vertical when the cover is in its second position with marginal edges of said cover sidewalls disposed on a substantially horizontal surface.

23. A protective display and gift package as defined in claim 20 wherein the clasp means includes a pair of outwardly extending laterally spaced retaining fingers operative to receive and releasable retain a product therebetween.

* * * * *